US009515423B2

(12) United States Patent
De France et al.

(10) Patent No.: US 9,515,423 B2
(45) Date of Patent: Dec. 6, 2016

(54) TAPERED GROUND STRAP SHIELD CONNECTOR

(71) Applicant: Hubbell Incorporated, Shelton, CT (US)

(72) Inventors: Robert V. De France, Poughkeepsie, NY (US); Daniel D. Dobrinski, Hillsboro, NH (US)

(73) Assignee: Hubbell Incorporated, Shelton, CT (US)

( * ) Notice: Subject to any disclaimer, the term of this patent is extended or adjusted under 35 U.S.C. 154(b) by 0 days.

(21) Appl. No.: 14/945,523

(22) Filed: Nov. 19, 2015

(65) Prior Publication Data

US 2016/0072230 A1 Mar. 10, 2016

Related U.S. Application Data

(63) Continuation of application No. 14/072,264, filed on Nov. 5, 2013, now Pat. No. 9,196,976.

(60) Provisional application No. 61/723,871, filed on Nov. 8, 2012.

(51) Int. Cl.

| | |
|---|---|
| ***H01R 4/66*** | (2006.01) |
| ***H01R 13/6581*** | (2011.01) |
| ***H01R 9/05*** | (2006.01) |
| ***H01R 43/16*** | (2006.01) |

(52) U.S. Cl.

CPC ..... *H01R 13/6581* (2013.01); *H01R 9/0512* (2013.01); *H01R 9/0521* (2013.01); *H01R 43/16* (2013.01); *Y10T 29/49174* (2015.01)

(58) Field of Classification Search

CPC ..... H01R 4/646; H01R 31/06
USPC ..... 439/98, 99, 502, 651; 174/78
See application file for complete search history.

(56) References Cited

U.S. PATENT DOCUMENTS

| | | | | |
|---|---|---|---|---|
| 4,310,209 | A * | 1/1982 | Fleming | H01R 4/646 439/781 |
| 4,503,283 | A * | 3/1985 | Hancock | H02G 15/117 156/49 |
| 4,696,649 | A * | 9/1987 | Smorzaniuk | H01R 4/646 174/71 R |
| 4,739,126 | A * | 4/1988 | Gutter | H02G 3/065 174/655 |
| 4,810,832 | A * | 3/1989 | Spinner | H01R 13/5205 174/654 |
| 5,491,766 | A * | 2/1996 | Huynh | G02B 6/00 385/100 |
| 5,597,314 | A * | 1/1997 | Auclair | H01R 4/363 439/793 |

(Continued)

*Primary Examiner* — Thanh Tam Le
(74) *Attorney, Agent, or Firm* — Michael Best & Friedrich, LLP

(57) ABSTRACT

A ground strap shield connection includes a body member disposed between an insulation layer and a ground shield of a first cable. The body member has a first tapered portion and a first threaded portion on an outer surface thereof. A cap member has a second tapered portion and a second threaded portion on an inner surface thereof. The ground shield of the first cable is disposed between the first and second tapered portions of the body member and the cap member when the first and second threaded portions are engaged. A ground strap has a first end connected to the cap member and a second end connectable to another ground strap of another ground strap shield connector connected to a second cable.

12 Claims, 9 Drawing Sheets

(56) References Cited

U.S. PATENT DOCUMENTS

| | | | | | |
|---|---|---|---|---|---|
| 5,644,673 | A * | 7/1997 | Patterson | G02B 6/3887 | 385/138 |
| 5,722,841 | A * | 3/1998 | Wright | H01R 9/0518 | 174/78 |
| 8,039,745 | B2 * | 10/2011 | Sedor | G02B 6/4477 | 174/74 R |
| 8,777,643 | B2 * | 7/2014 | De France | H01R 9/0524 | 174/78 |

* cited by examiner

TAPERED GROUND STRAP SHIELD CONNECTOR

CROSS REFERENCE TO RELATED APPLICATION

This application is a continuation of U.S. application Ser. No. 14/072,264 filed Nov. 5, 2013 which claims the benefit under 35 U.S.C. §119(e) of U.S. Provisional Application Ser. No. 61/723,871, filed Nov. 8, 2012, which are hereby incorporated by reference in their entirety.

FIELD OF THE INVENTION

The present invention relates generally to a tapered ground strap shield connector disposable on a cable. More particularly, the present invention relates to a ground strap shield connector having a tapered body member disposable between an inner insulation layer and a ground shield of a cable and a cap disposable on the ground shield substantially surrounding the body member. Still more particularly, the present invention relates to a first tapered ground strap shield connector disposable on a first cable, a second tapered ground strap shield connector disposable on a second cable, and a ground strap connecting the first and second tapered ground strap shield connectors to maintain continuity of ground shields of the first and second cables.

BACKGROUND OF THE INVENTION

A conventional shielded cable typically includes an inner power carrying conductor covered by an inner insulation layer, which is covered by a ground shield. An outer insulation layer covers the ground shield. When two shielded cables are spliced together, the ground shields cannot be electrically disconnected and continuity therebetween must be maintained.

Existing methods for connecting ground shields of cables being spliced together are labor intensive and difficult. The ground shield is typically entirely covered by the outer insulation layer, which must be removed to expose the ground shield. The ground shield must then be separated from the inner insulation layer. The separated ground shield is then twisted together to form a substantially cylindrical and solid-shaped conductor. The twisted ground shield is then inserted in a terminal lug connector. A first end of a jumper cable is attached to the terminal lug. A second end of the jumper cable is connected to a corresponding terminal lug on the other cable, which is prepared in the same manner. The jumper cable running between the terminal lugs at each cable end maintains the continuity of the ground shields. Accordingly, a need exists for more quickly and easily maintaining continuity of the ground shields of two cables being spliced together.

Another problem associated with maintaining the continuity of the ground shields is that different types of ground shield conductors have different types of ground shields. The ground shields can have different configurations and sizes, such as being flat, round or foil, as well as having various thicknesses or gages. Thus, a large inventory of ground shield connectors are required to accommodate the various ground shields used with different ground shield conductors. Accordingly, a need exists for a ground strap shield connector that accommodates the variously configured ground shields of different ground shield conductors.

SUMMARY OF THE INVENTION

An object of the present invention is to provide a ground strap shield connector for connecting ground shields of cables being spliced together to maintain continuity of the ground shields.

Another object of the present invention is to provide a ground strap shield connector that is quickly and easily connected to a first cable to be spliced to second cable.

Still another objective of the present invention is to provide a ground strap shield connector that accommodates the variously configured ground shields of different ground shield conductors.

The foregoing objectives are basically attained by a ground strap shield connection including a body member disposed between an insulation layer and a ground shield of a first cable. The body member has a first tapered portion and a first threaded portion on an outer surface thereof. A cap member has a second tapered portion and a second threaded portion on an inner surface thereof. The ground shield of the first cable is disposed between the first and second tapered portions of the body member and the cap member when the first and second threaded portions are engaged. A ground strap has a first end connected to the cap member and a second end connectable to another ground strap of another ground strap shield connector connected to a second cable.

The foregoing objectives are also basically attained by a ground strap shield connection assembly including first and second ground strap shield connectors connected to ends of first and second cables. The first and second ground strap shield connectors include first and second body members. Each body member is disposed between an insulation layer and a ground shield of the respective cable. The body member has a first tapered portion and a first threaded portion on an outer surface thereof. Each of first and second cap members has a second tapered portion and a second threaded portion on an inner surface thereof. The ground shield of the respective cable being disposed between the first and second tapered portions of the respective body member and the respective cap member when the first and second threaded portions are engaged. Each of first and second ground straps has a first end connected to the respective cap member. A first fastener connects second ends of the first and second ground straps together, thereby electrically connecting the ground shields of the first and second cables.

The foregoing objectives are also basically attained by a method of electrically connecting cable ground shields. A first body member is inserted between a first insulation layer and a first ground shield of a first cable. A first cap member is connected to the first body member such that the first ground shield is disposed between tapered portions of the first cap member and the first body member. The first ground shield is clamped against the tapered portion of the first body member by inserting a first fastener through a first fastener hole in the first cap member to engage the first ground shield.

Other objects, advantages and salient features of the invention will become apparent from the following detailed description, which, taken in conjunction with the annexed drawings, discloses a preferred embodiment of the invention.

As used in this application, the terms "front," "rear," "upper," "lower," "upwardly," "downwardly," and other orientational descriptors are intended to facilitate the description of the tapered ground strap shield connector, and are not intended to limit the structure of the tapered ground strap shield connector to any particular position or orientation.

BRIEF DESCRIPTION OF THE DRAWINGS

The above aspects and features of the present invention will be more apparent from the description for an exemplary embodiment of the present invention taken with reference to the accompanying drawings, in which.

Throughout the drawings, like reference numerals will be understood to refer to like parts, components and structures.

DETAILED DESCRIPTION OF EXEMPLARY EMBODIMENT

As shown in FIGS. 1-18, a ground strap shield connector 1 in accordance with an exemplary embodiment of the present invention accommodates ground shields 13 having various configurations and sizes without interchanging any components of the ground strap shield connector 1.

Figure 1:
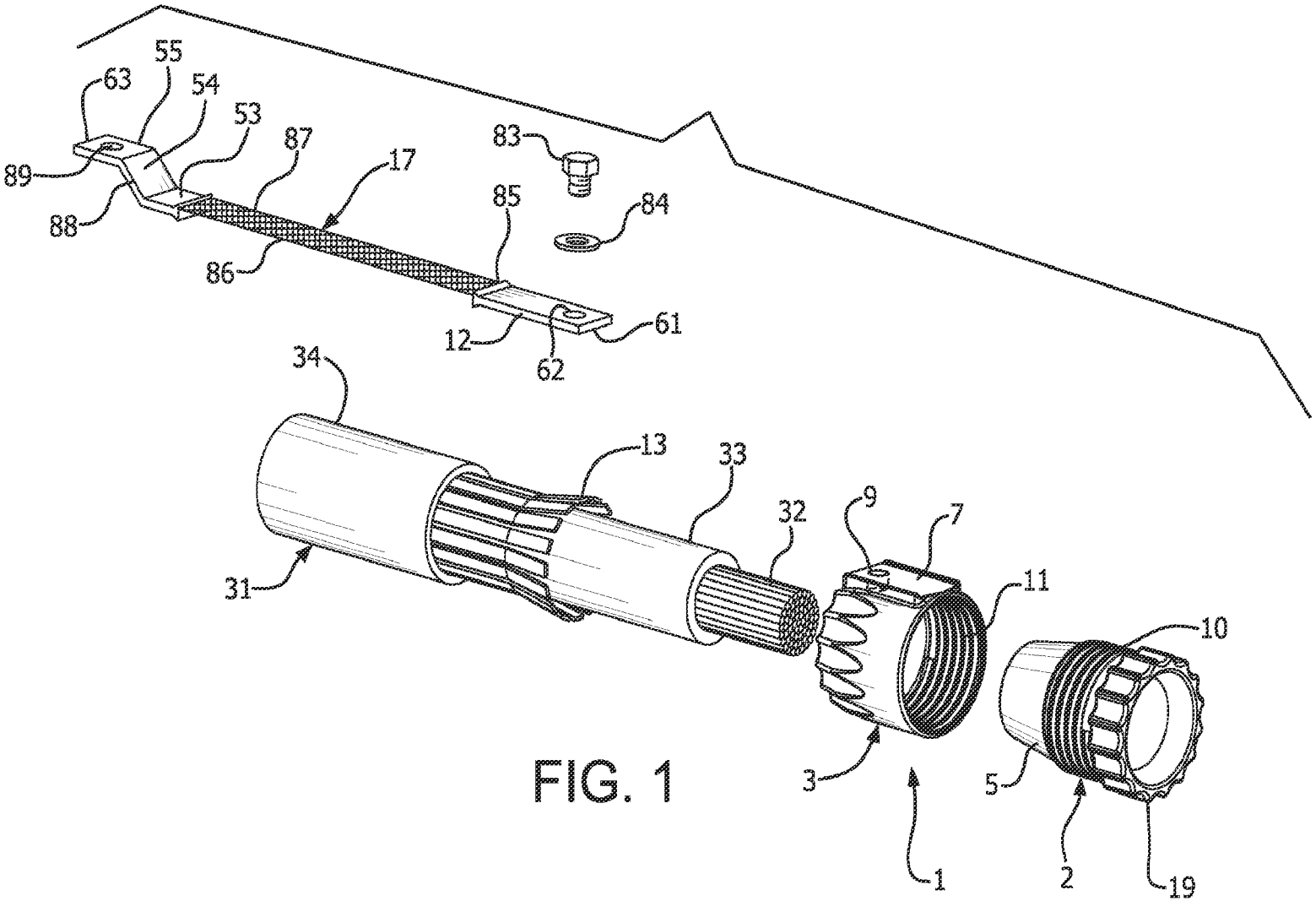
FIG. 1 is an exploded perspective view of a ground strap shield connector in accordance with a first exemplary embodiment of the present invention.
Figure 2:
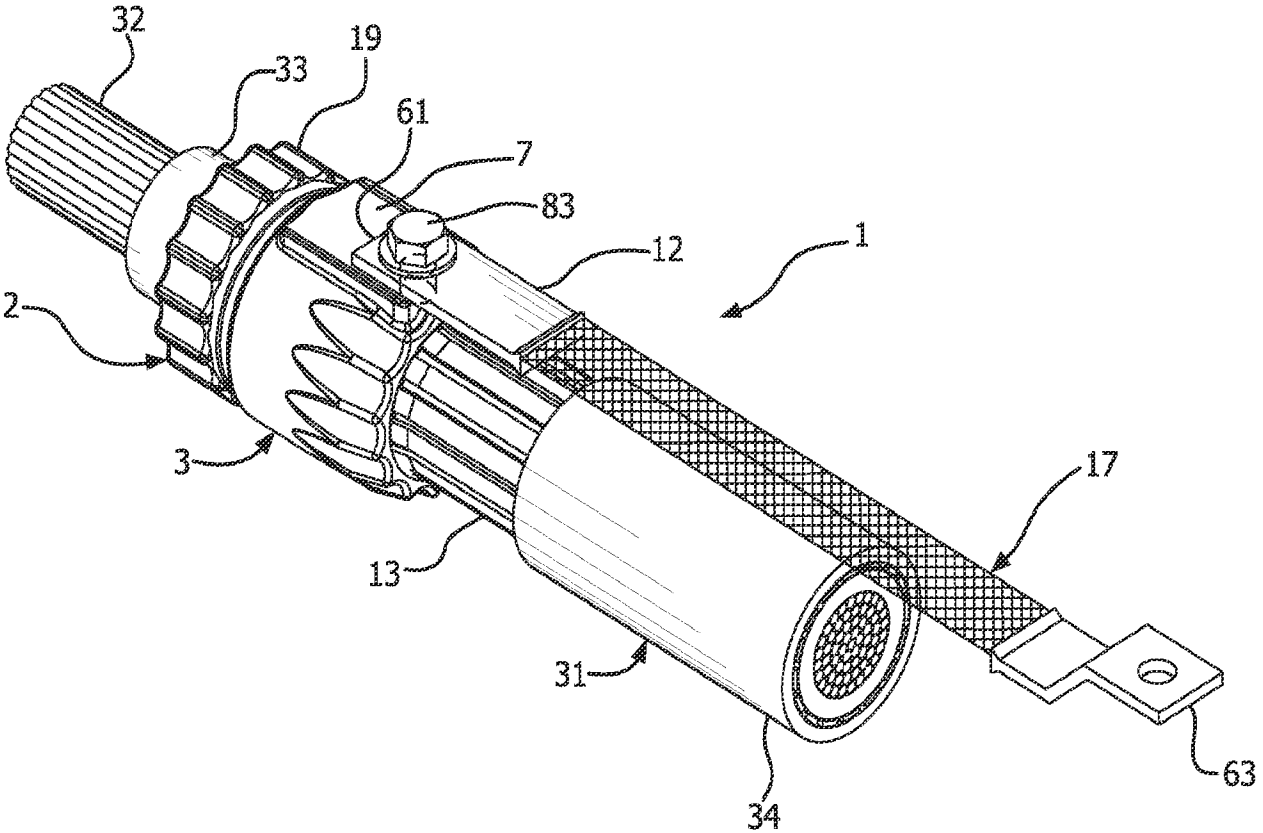
FIG. 2 is a perspective view of the assembled ground strap shield connector of FIG. 1.
Figure 14:
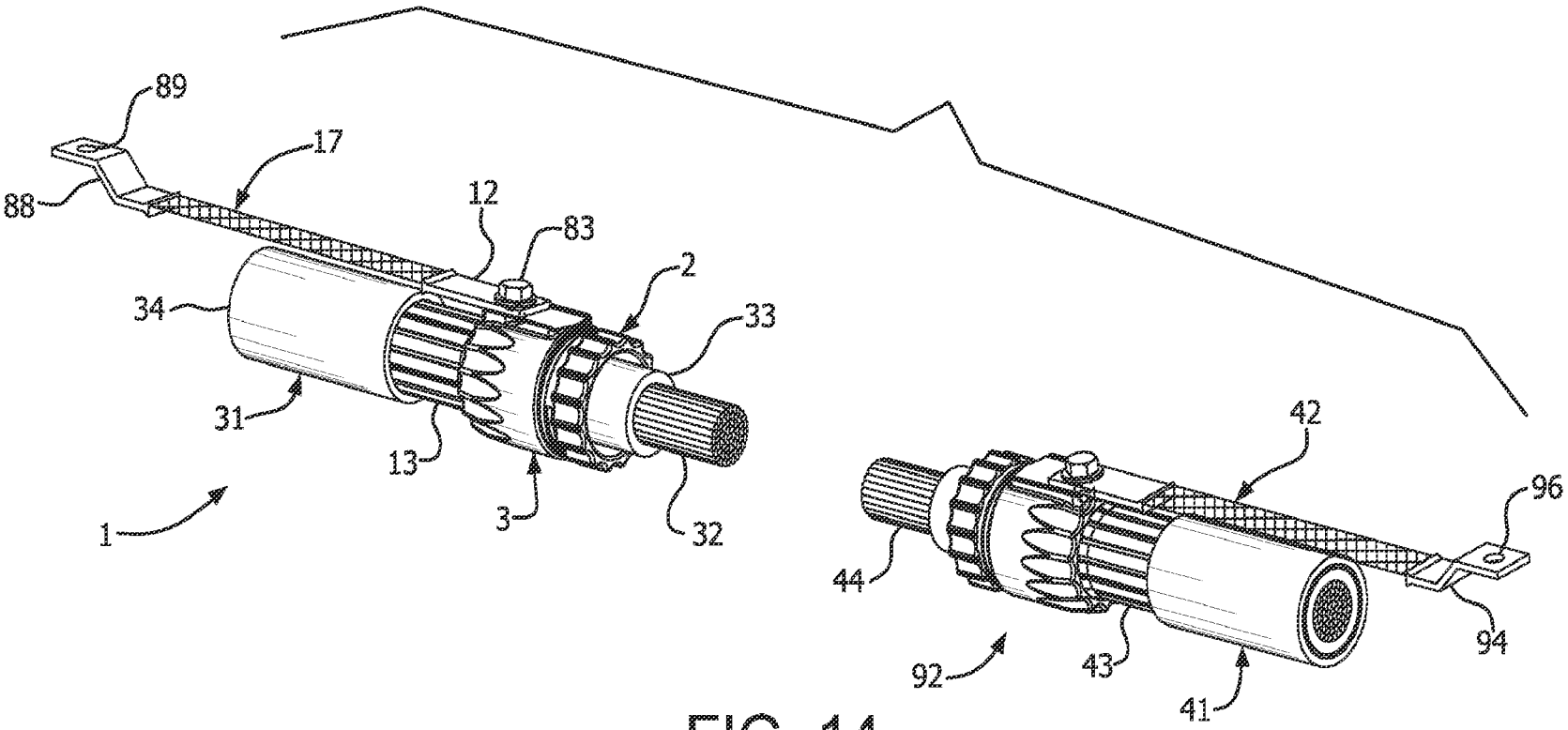
FIG. 14 is a perspective view of the ground strap shield connector of FIG. 1 connected to ends of first and second cables.
Figure 15:
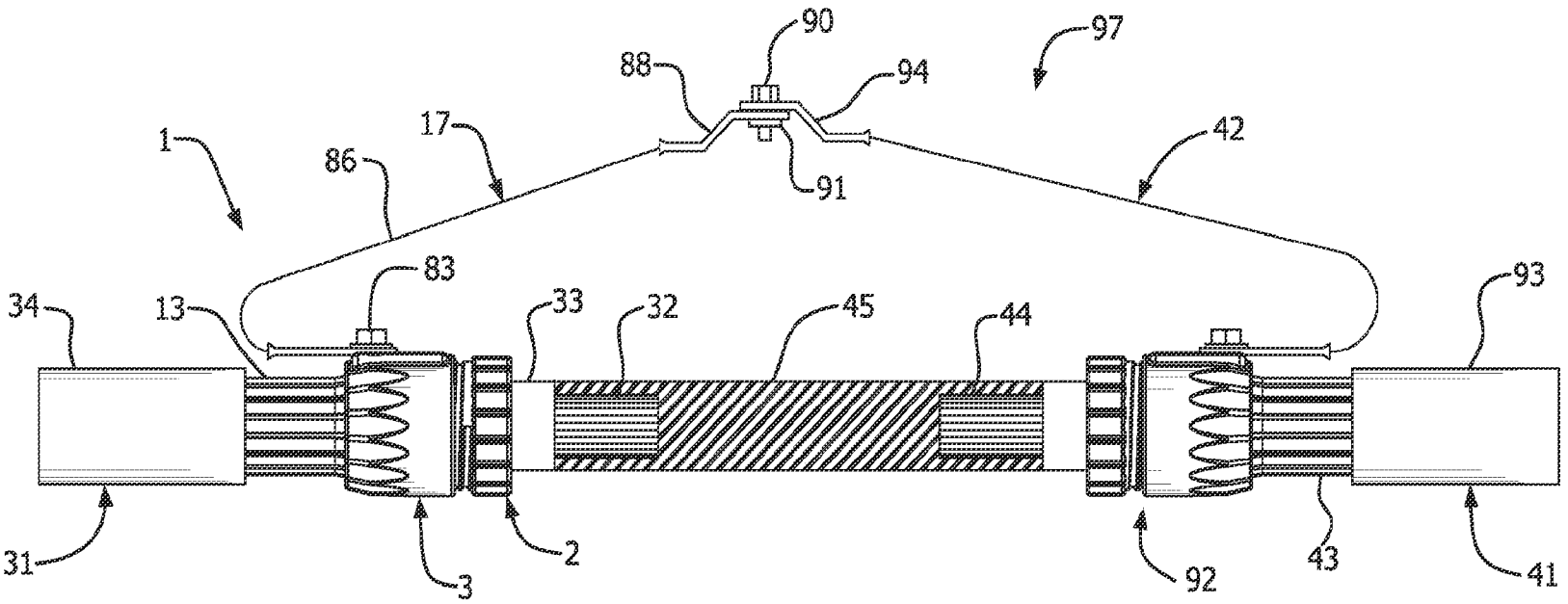
FIG. 15 is a side elevational view in partial section of a first ground strap shield connector of FIG. 1 connected to a second ground strap shield connector.

A first cable 31 includes a conductor 32 surrounded by an inner insulation layer 33, as shown in FIGS. 1 and 2. The conductor 32 is preferably made of copper. A ground shield 13 surrounds the inner insulation layer 33. An outer insulation layer 34 surrounds the ground shield 13. Portions of the inner insulation layer 33, the ground shield 13 and the outer insulation layer 34 are removed from the cable 31 to prepare the first cable 31 to be spliced with a second cable 41, as shown in FIGS. 14 and 15. The first and second cables 31 and 41 are preferably substantially identical.

Figure 16:
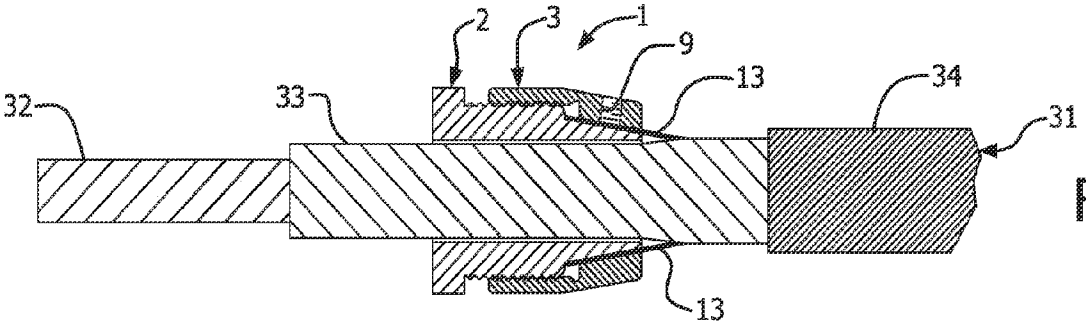
FIG. 16 is a side elevational view in section of the ground strap shield connector of FIG. 1 connected to a first ground shield conductor.
Figure 17:
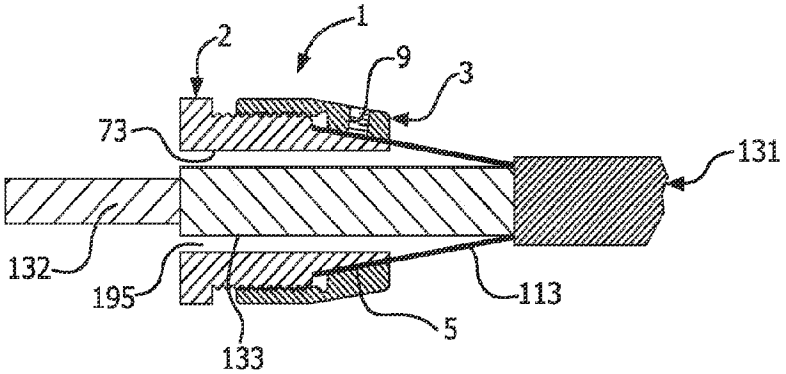
FIG. 17 is a side elevational view in section of the ground strap shield connector of FIG. 1 connected to a second ground shield conductor with space between an inner surface of a body and an outer surface of an insulation layer of the conductor.
Figure 18:
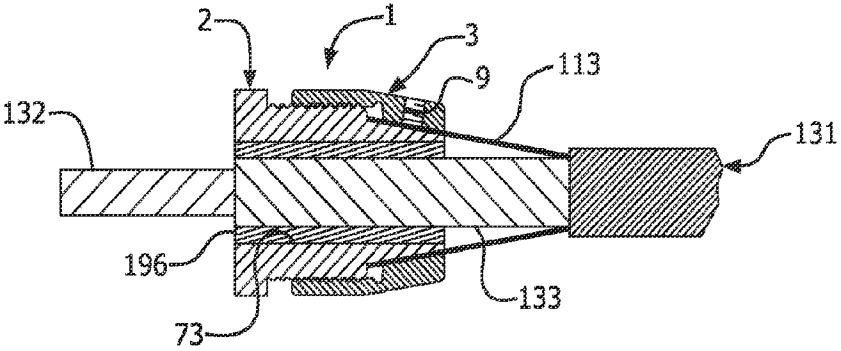
FIG. 18 is a side elevational view in section of the ground strap shield connector of connected to the second ground shield conductor of FIG. 17 with a spacer disposed between the body of the connector and the insulation layer of the conductor.

The ground strap shield connector 1 includes a substantially cylindrical inner body member or body 2 received by a substantially cylindrical outer body member or cap 3, as shown in FIGS. 1-7 and 13. The body 2 is disposable between the inner insulation layer 33 and the ground shield 13 of the cable 31, as shown in FIGS. 16-18. The cap 3 is disposed on a portion of the ground shield 13 such that the outer cap substantially surrounds the body 2. A ground strap 17 has a first end 61 connected to the cap 3 and a second end 63 connected to a second ground strap 42, as shown in FIG. 15, thereby maintaining the continuity of the ground shields 13 and 43. The ground strap shield connector 1 of the exemplary embodiments of the present invention can accommodate any size or configuration ground shield used with ground shield cables 31, as shown in FIGS. 16-18.

Figure 4:
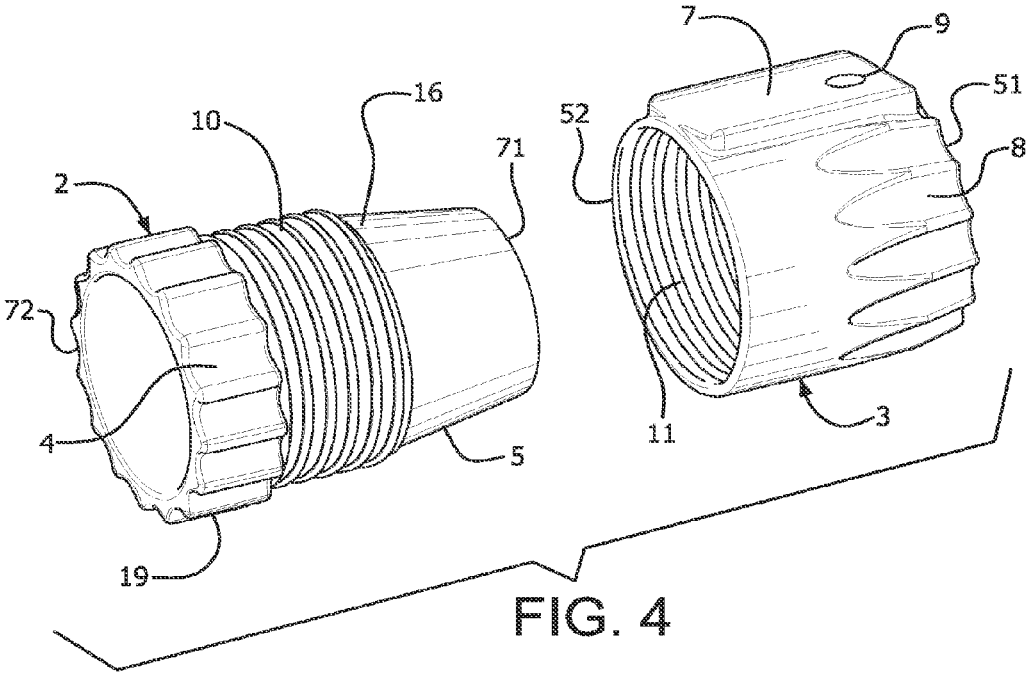
FIG. 4 is an exploded perspective view of the body and cap of FIG. 3.
Figure 5:
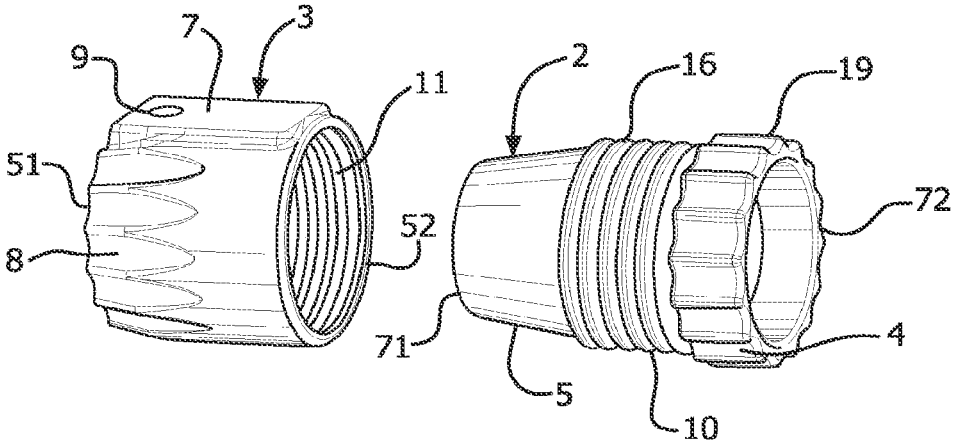
FIG. 5 is an exploded perspective view of the body and cap of FIG. 3.
Figure 6:
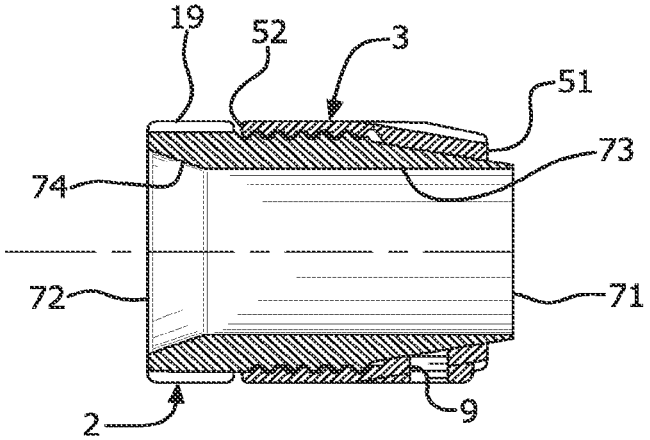
FIG. 6 is a side elevational view in cross-section of the assembled body and cap of FIG. 3.
Figure 7:
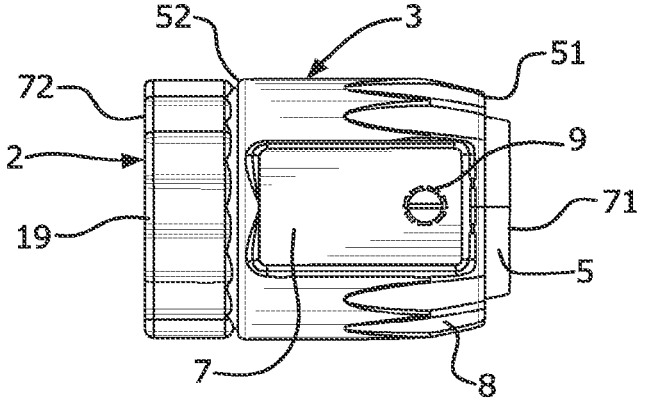
FIG. 7 is a top plan view of the assembled body and cap of FIG. 3.
Figure 13:
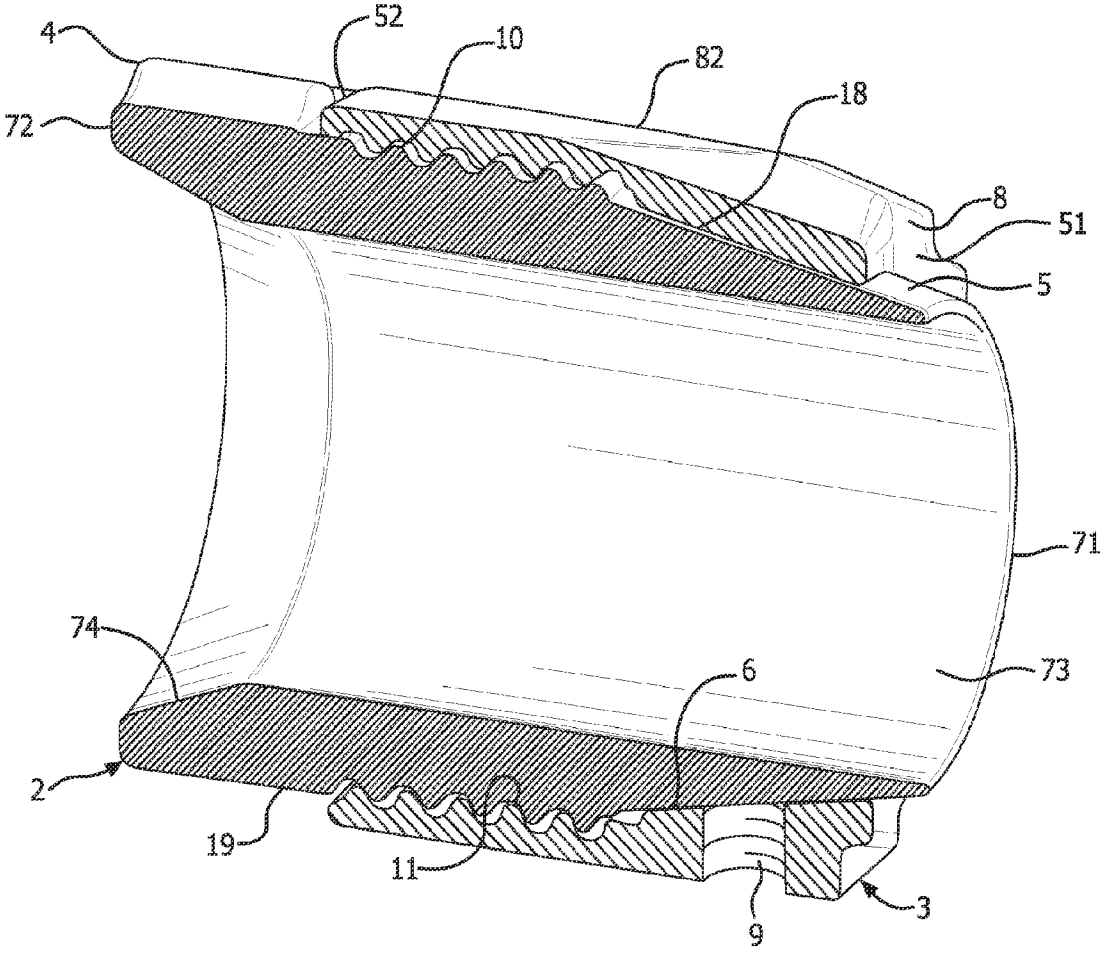
FIG. 13 is an enlarged perspective view in cross-section of the assembled cap and body of FIG. 3.

The outer surface 16 of the body 2 has a tapered portion 5 at a first end 71, as shown in FIGS. 1, 4 and 5. A threaded portion 10 of the outer surface 16 is adjacent the tapered portion 5. A flange, or gripping member, 19 is disposed at a second end 72 of the body 2 adjacent the threaded portion 10 such that the threaded portion is disposed between the tapered portion 5 and the flange 19. The tapered portion 10 tapers inwardly from the threaded portion 10 toward the first end 71. The flange 19, preferably, has a plurality of notches 4 disposed on an outer perimeter thereof to enable a lineman to get a secure grip during assembly. Any suitable gripping feature can be disposed on the flange 19 to facilitate gripping during installation. An inner surface 73 of the body 2 preferably has a substantially constant inner diameter along a majority of its length, as shown in FIGS. 6, 13 and 16-18. The inner surface 73 has a tapered portion 74 adjacent the second end 72. The tapered portion 74 preferably tapers inwardly from the second end 72, as shown in FIGS. 6 and 13. The inner tapered portion 72 facilitates insertion of a filler sleeve 196, as shown in FIG. 18. The body 2 is preferably made of bronze or brass.

Figure 3:
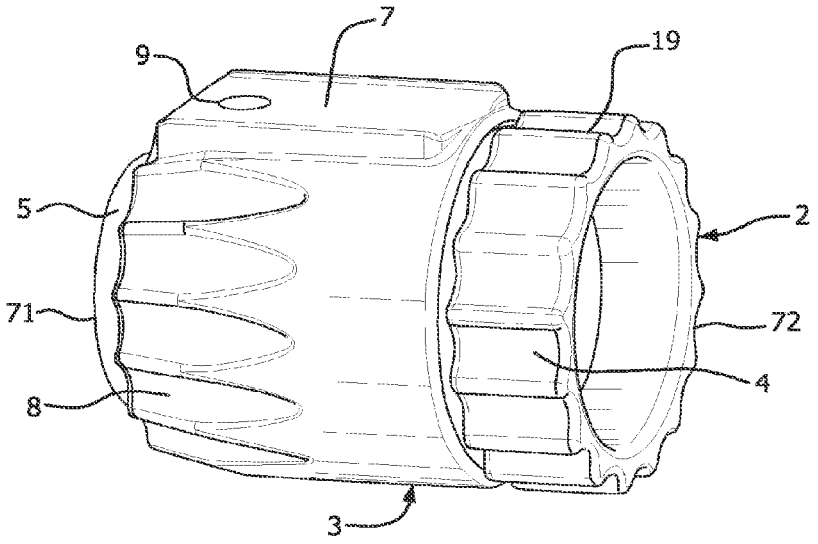
FIG. 3 is a perspective view of an assembled body and cap of the ground strap shield connector of FIG. 1.
Figure 12:
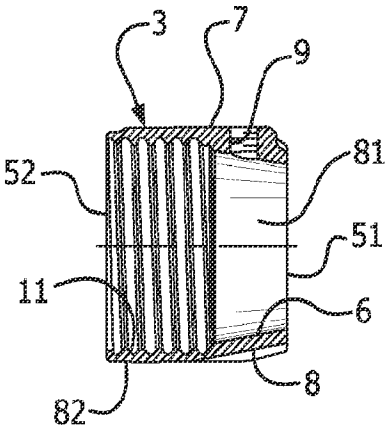
FIG. 12 is a side elevational view in cross-section of the cap taken along line 12-12 of FIG. 11.
Figure 11:
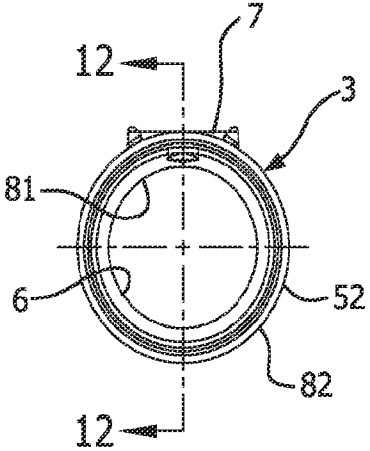
FIG. 11 is a rear elevational view of the cap of FIG. 1.
Figure 9:
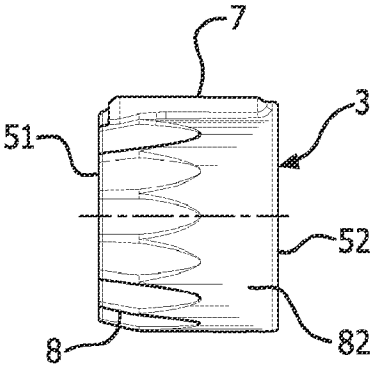
FIG. 9 is a side elevational view of the cap of FIG. 1.
Figure 10:
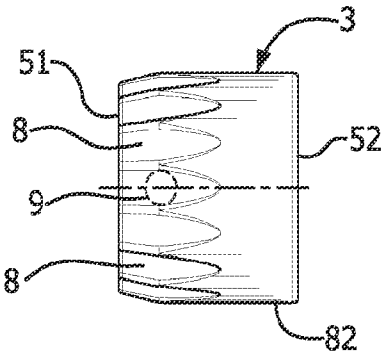
FIG. 10 is a bottom plan view of the cap of FIG. 1.
Figure 8:
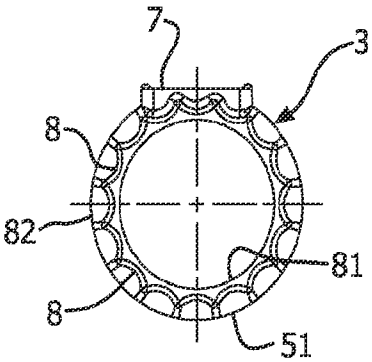
FIG. 8 is a front elevational view of the cap of the ground strap shield connector of FIG. 1.

The cap 3 has an inner surface 81 having a tapered portion 6 at a first end 51 and a threaded portion 11 at a second end 52, as shown in FIGS. 6, 12 and 13. An outer surface 82 of the cap 3 has a plurality of notches 8 that facilitate gripping by the lineman during assembly. Any suitable gripping feature can be disposed on the outer surface 82 of the cap 3 to facilitate gripping during installation. As shown in FIGS. 3 and 4, the body notches 4 and the cap notches 8 are disposed at opposite ends of the assembled body 2 and cap 3. A substantially flat, or planar, surface 7 is disposed on an outer surface of the cap 3. A threaded fastener hole 9 in the flat surface 7 receives a fastener 83 for securing a first terminal lug 12 of a ground strap 17 thereto. Prior to installing the fastener 83, the fastener hole 9 provides the lineman with a visual indication that the ground shield 13 is fully inserted. A properly inserted ground shield 13 is visible through the fastener hole 9, as shown in FIG. 16. The fastener 83 engages the ground shield 13 disposed on the tapered portion 5 of the body 2, thereby applying pressure on the tapered portion 5 to further secure the body 2 and cap 3 together. After the cap 3 is threaded onto the body 2, the fastener 83 is inserted through the fastener opening 9 to further prevent the body 2 and cap 3 from loosening. The cap 3 is preferably made of bronze or brass.

The ground strap 17 includes a braided wire 86 having first and second ends 85 and 87, as shown in FIG. 1. A first terminal lug 12 is connected to the first end 85 of the braided wire 86, and a second terminal lug 88 is connected to the second end 87 of the braided wire 86. Preferably, the first and second ends 85 and 87 of the braided wire 86 are crimped to the first and second terminal lugs 12 and 88, respectively. The first terminal lug 12 is preferably substantially planar and has a fastener hole 62 therein. The second terminal lug 88 has a first substantially planar portion 53 to which the second end 87 of the braided wire 86 is connected and a second substantially planar portion 55 having a fastener hole 89 therein. The fastener holes 62 and 89 are preferably through-holes. An angled portion 54 of the second terminal lug 88 connects the first and second substantially planar portions 53 and 55.

Assembly and Operation

The ground shield cable 31 is prepared for splicing by cutting back the inner insulation layer 33 to expose the electrical current carrying conductor 32, which is typically made of copper and/or aluminum. The outer insulation layer 34 is then cut back to expose the ground shield 13, as shown in FIGS. 1 and 16-18.

The cap 3 is then installed on the outer insulation layer 34 such that the inner tapered portion 6 is disposed rearwardly of the exposed ground shield 13. The body 2 is then installed on cable 31 such that the tapered portion 5 is disposed under or radially within the exposed ground shield 13 such that the tapered portion 5 of the body 2 is disposed between the inner insulation layer 33 and the ground shield 13. The ground shield 13 contacts the tapered portion 5 and does not interfere with the threaded portion 10 of the body 2. The cap 3 is then slid toward the body 2 until the inner threaded portion 11 of the cap 3 threadably engages the outer threaded portion 10 of the body 2 entrapping the shield 13 between the body tapered portion 5 and the cap tapered portion 6.

After the threaded portions 10 and 11 of the body 2 and cap 3 are engaged, the cap 3 and body 2 can be rotated in a counter-clockwise direction (left-hand threads) until the body 2 and cap 3 are secured, thereby compressing the ground shield 13 therebetween. The ground shield 13 is visible through the fastener hole 9 in the cap 3 when the ground shield 13 is properly secured between the body tapered portion 5 and the cap tapered portion 6.

As the tapered portion 6 of the cap 3 travels forward, a gap 18 between the two tapered portions 5 and 6 decreases, as shown in FIG. 13. The greater the threaded engagement between the cap 3 and body 2, the smaller the gap 18 between the tapered portions 5 and 6. Accordingly, the ground strap shield connector 1 can accommodate ground shields 13 of different configurations and thicknesses. The threaded portions 10 and 11 of the body 2 and cap 3, which are preferably left-hand knuckle threads, allow the ground shield 13 to remain uniformly in lay as the body 2 and cap 3 are assembled. All underground ground shield cables 31 are manufactured with the ground shield 13 having a left-hand wrap. The ground strap shield connector 1 allows the lineman to apply a sufficient amount of sealant to prevent any failures. Sealant can be applied both under and over the ground shield 13. The ground shield 13 can be folded back approximately 180 degrees such that a first application of sealant can be disposed on the inner insulation layer 33 under the ground shield. The ground shield 13 can then be folded back to its original location and a second application of sealant can be applied over the ground shield 13.

The first terminal lug 12 of the ground strap 17 is then connected with the fastener 83 and a washer 84 to the substantially planar surface 7 of the cap 3. The fastener 83 is inserted through the fastener hole 62 in the first terminal lug 12 and threaded into the fastener hole 9 in the substantially planar surface 7 of the cap 3 to secure the ground strap 17 to the cap 3 and to further secure the body 2 and cap 3 together. The fastener 83 engages the ground shield 13 to apply pressure to the tapered portion 5 of the body 2 to further secure the body 2 and cap 3 together. The above assembly procedure is then repeated to secure a second ground strap shield connector 92 to a second ground strap cable 41, as shown in FIGS. 14 and 15. The second ground strap shield connector 92 is substantially identical to the first ground strap shield connector 1.

A fastener hole 96 in a second terminal lug 94 of the second ground strap shield connector 92 is aligned with the fastener hole 89 in the second terminal lug 88 of the first ground strap shield connector 1, as shown in FIG. 15. Preferably, the braided wires 86 of the first and second ground straps 17 and 42 are flexible to facilitate aligning the fastener holes 89 and 96 of the second terminal lugs 88 and 94. A fastener 90 inserted through the aligned fastener holes 89 and 96 receives a nut 91 to secure the second terminal lugs 88 and 94 together, thereby assembling the ground strap shield connector assembly 97 and electrically connecting the ground shields 13 and 43 of the first and second cables 13 and 41 to maintain electrical continuity therebetween.

To splice the first and second cables 31 and 41 together, the conductor 32 of the first cable 31 and a conductor 44 of the second cable 41 are inserted in opposite ends of a cylindrical tube 45, as shown in FIG. 15. The cylindrical tube 45 is then crimped to secure the conductors 32 and 44 thereto. The cylindrical tube 45 is preferably either aluminum or copper and is determined by the conductor material. An insulating material, such as rubber, covers the crimped tube 45. A first heat shrinking member covers the first ground strap connecting member 1 and extends from the outer insulation layer 34 to the insulating material of the crimped tube 45. A second heat shrinking member covers the second ground strap connecting member 92 and extends from an outer insulation layer 93 of the second cable 41 to the insulating material of the crimped tube 45. Heat is then applied to the first and second heat shrinking members to seal the connections at each end of the cables 31 and 41.

The ground strap shield connector 1 of the exemplary embodiment of the present invention can accommodate any size or configuration ground shield used with ground shield cables, as shown in FIGS. 16-18. As shown in FIG. 16, the ground strap shield connector 1 is secured to a first cable 31 having a ground shield 13. As shown in FIGS. 17 and 18, the ground strap shield connector 1 is secured to a different cable 131 having a differently sized ground shield 113 and conductor 132. A space 195 may be disposed between the outer surface of the inner insulation layer 133 and the inner diameter of the body 2, as shown in FIG. 17. When the ground shield 113 is secured between the body 2 and the cap 3, the strength of the ground shield 113 substantially centers the ground strap shield connector 1 on the conductor 131. Alternatively, a filler sleeve 196 can be disposed between the inner insulation layer 133 and the body 2, as shown in FIG. 18. For example, the filler sleeve 196 can be used when the distance between the outer surface of the inner insulation layer 133 and the inner surface of the body 2 is greater than approximately ⅛." The filler sleeve 196 is preferably substantially cylindrical and made of plastic.

While advantageous embodiments have been chosen to illustrate the invention, it will be understood by those skilled in the art that various changes and modifications may be made therein without departing from the scope of the invention as defined in the appended claims and their equivalents.

What is claimed is:

1. A ground strap shield connection, comprising:

a body member disposed between an insulation layer and a ground shield of a first cable, said body member having a first tapered portion and a first threaded portion on an outer surface thereof;

a cap member having a second tapered portion and a second threaded portion on an inner surface thereof, the ground shield of the first cable being disposed between said first and second tapered portions of said body member and said cap member when said first and second threaded portions are engaged; and a ground strap having a first end connected to said cap member and a second end connectable to another ground strap of another ground strap shield connector connected to a second cable; wherein the ground shield contacts the first and second tapered portions and does not interfere with the first and second threaded portions.

2. The ground strap shield connection according to claim 1, wherein said outer surface of said cap member has a flange having a plurality of notches therein to facilitate gripping said cap member.

3. The ground strap shield connection according to claim 1, wherein a fastener hole in said cap member receives a fastener connecting said ground strap thereto and extends from an outer surface to said second tapered portion of said inner surface.

4. The ground strap shield connection according to claim 3, wherein said fastener engages the ground shield to facilitate clamping the ground shield between said first and second tapered portions of said body member and said cap member.

5. The ground strap shield connection according to claim 1, wherein an inner surface of said body member is spaced from an outer surface of the insulation layer of the first cable.

6. The ground strap shield connection according to claim 1, wherein a filler sleeve is disposed between said an inner surface of said body member and an outer surface of the insulation layer of the first cable.

7. The ground strap shield connection according to claim 6, wherein said inner surface of said body member has a third tapered portion to facilitate receiving said filler sleeve.

8. The ground strap shield connection according to claim 1, wherein said ground strap includes a flexible portion to facilitate connecting to another ground strap.

9. A method of electrically connecting cable ground shields, comprising the steps of:

inserting a first body member between a first insulation layer and a first ground shield of a first cable;

connecting a first cap member to the first body member such that the first ground shield is disposed between tapered portions of the first cap member and the first body member; and clamping the first ground shield against the tapered portion of the first body member by inserting a first fastener through a first fastener hole in the first cap member to engage the first ground shield; wherein the first ground shield contacts the tapered portions and does not interfere with threaded portions.

10. The method of electrically connecting cable ground shields according to claim 9, further comprising:

ensuring full insertion of the first ground shield between the first body member and the first cap member by viewing the first ground shield through the first fastener hole prior to inserting the first fastener therein.

11. The method of electrically connecting cable ground shields according to claim 9, further comprising:

inserting a second body member between a second insulation layer and a second ground shield of a second cable;

connecting a second cap member to the second body member such that the second ground shield is disposed between tapered portions of the second cap member and the second body member;

clamping the second ground shield against the tapered portion of the second body member by inserting a second fastener through a second fastener hole in the second cap member to engage the second ground shield;

connecting first and second ground straps to said first and second cap members respectively; and connecting the first and second ground straps, thereby electrically connecting the first and second ground shields of the first and second cables.

12. The method of electrically connecting cable ground shields according to claim 9, wherein the first body member and the first cap member are threadably connected.

* * * * *